United States Patent [19]

Vrana

[11] Patent Number: 4,598,905

[45] Date of Patent: Jul. 8, 1986

[54] TRAMPOLINE EXERCISE STEADING STRUCTURE

[76] Inventor: Charles K. Vrana, 60 Helen La., Ft. Myers Beach, Fla. 33931

[21] Appl. No.: 684,079

[22] Filed: Dec. 20, 1984

[51] Int. Cl.[4] ..... A63B 5/00

[52] U.S. Cl. ..... 272/65; 272/146

[58] Field of Search ..... 272/65, 69, 109, 144, 272/DIG. 9, 70, 70.3, 146, 62, 66, 93, 112, 145; 248/68.1, 230; 135/DIG. 9

[56] References Cited

U.S. PATENT DOCUMENTS

| | | | |
|---|---|---|---|
| 2,324,970 | 7/1943 | Woolley | 272/65 |
| 3,659,844 | 5/1972 | Cummins | 272/109 |
| 3,756,595 | 9/1973 | Hague | 272/70 |
| 4,305,579 | 12/1981 | Rice | 272/146 |
| 4,369,966 | 1/1983 | Silberman et al. | 272/62 |
| 4,391,441 | 7/1983 | Simjian | 272/146 |
| 4,407,472 | 10/1983 | Beck | 248/68.1 |
| 4,478,420 | 10/1984 | Sowards | 272/65 |
| 4,489,933 | 12/1984 | Fisher et al. | 272/146 |

FOREIGN PATENT DOCUMENTS

| | | | |
|---|---|---|---|
| 1140960 | 2/1983 | Canada | 272/65 |
| 211452 | 7/1909 | Fed. Rep. of Germany | 272/69 |

*Primary Examiner*—Richard J. Apley
*Assistant Examiner*—S. R. Crow

[57] ABSTRACT

An attachable safety steadying structure for the conventional trampoline comprising sturdy upright members spaced apart on the trampoline, joined at the top by a horizontal bar member, designed for the elderly and infirm to hold-on to while exercising, which safety structure can also be purchased separately for those who already have the naked trampoline.

1 Claim, 3 Drawing Figures

TRAMPOLINE EXERCISE STEADING STRUCTURE

BACKGROUND OF THE INVENTION

This invention relates to a simple and inexpensive safety structure addition to the conventional trampoline, removably fastened thereto, to make it safe and reliable for the elderly and infirm. The elderly and infirm need the potential and easy exercise benefits of the trampoline in its aerobic, bounce and rhythmic rebounding mode, yet stay away from same because of the imbalance and fall hazards of rebounding without any safety structure to give them confidence and hold-on safety assurance.

The simple conventional trampoline, round or rectangular, in its naked condition, that is without any hold-on or steading support, consists generally of a tough polypropylene center attached to steel tubing by high tension steel springs and a padded trim around the outer edge. The entire trampoline stands off the floor on rather short legs.

Younger folks find the trampoline, because of its rebounding, rhythmic and jar absorbing action, a super fun action device using very little physical effort to bounce and rebound. To this end it is therefore very beneficial to them. Old folks would likewise get the same stimulating health benefits from the free will bounce and rebounding trampoline, however infirmity prevents them from using the device because of real fear to injure themselves physically in an imbalance fall, especially those who suffer the brittle bone disease osteoporosis. Fact is imbalances do occur on the naked trampoline quite easily even to the young, and the elderly, because of their infirmity, stay away from it completely, thus lose its many health benefits.

OBJECT OF THE INVENTION

It is therefore the object of this invention to correct this hazardous condition by adding to said naked trampoline a pair of upright sturdy steel tubing members, or their equivalent, each removably secured to the legs, one on each side of said trampoline, joined at the top by a horizontal bar member to hold-on to. For further safety and stabilization for the excessively infirm or heavily obese, an extra supporting member is used to check the vibrations and sway of said pair of upright members.

The sole purpose of this safety exercise steading structure is to simply and inexpensively transform a hazardous condition for the elderly and infirm who need the potential and almost effortless stimulating exercise benefit of the rebounding trampoline the most, and which is ideal for them, into a safe and reliable fun provoking exercise device which otherwise would not be used by them.

It is also the object of this trampoline exercise steading structure addition that it may be purchased in the market place separately for those who already have the naked trampoline on hand.

Fearless confidence, stimulating fun exercise and controlled conscious active movement leading to more mental alertness, indicates the psychological benefits of this added structure to the trampoline for the elderly. Physically, this inexpensive improvement yields big necessary benefits such as limbering the body, aerobatics grace, exercise the heart, exercise the inner organs which includes easier waste elimination, improves the breathing, and improves the general body tone due to better blood circulation, and if desired, weight control, plus a happier life extention factor with consequent less aches and pains.

PRIOR ART

U.S. Pat. Nos. 4,477,070 & 4,225,131

It is known that hold-on means appear on some rebounding beds, but they are a part of rather heavy equipment and non-removable, and cannot be purchased separately for the multitude of naked rebounding beds already on the market. On others, the hold-on element is part of auxiliary equipment and not part of the rebounding bed proper. Said entire auxiliary section, featuring several other combined exercise devices, must be fastened to said rebounding bed as a combined whole to have the benefit of the hold-on member. It is judged, the elderly and infirm, to benefit in their limited sphere of exercise, will not subscribe financially to such a multiple exercise structural device because each exercise member on it has an included price, collectively totaling a handsum sum, and which the elderly would not use anyway because such are not suited for them physically. Advanced and strenuous routine exercise, which needs practice to achieve, for said elderly and infirm is totally out of their league. The purpose of the present invention is to make it safe, simple and inexpensive for the elderly and infirm.

Other objects of the invention will be apparent from reading the disclosure and claims which follow.

BRIEF DESCRIPTION OF THE DRAWINGS

FIG. 1 shows the safety exercise steading structure. Numeral 18 designates the trampoline proper. Upright members 19 are bolted by U bolts 22 to legs 11 using the opposite side grooved flange member 13 in between. Upright members 19 are joined at the top by a removable horizontal bar member 14,15. Each upright member 19, one on each side of trampoline 18, is supported by a diagonal member 20 stemming from said trampoline. The lower ends **20*b* of members 20 are bent at an angle to comply with the vertical legs 11, to be U bolted together according to member 13, FIG. 3. The upper ends of of members 20 are fastened to upright members 19 using clamp means 17, FIG. 2**. The above safety steady structure also to be purchased separately in a set, or in combination with the trampoline.

Figure 1:
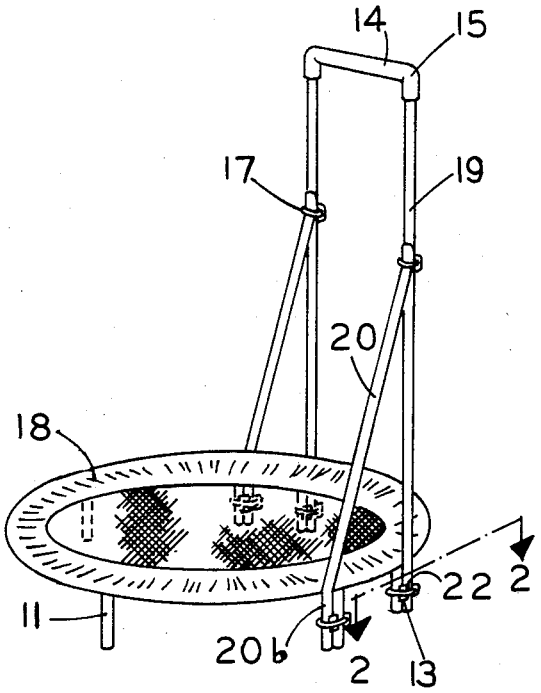
FIG. 1 Perspective view of trampoline having upright members, a horizontal bar member, and side supporting members.
Figure 2:
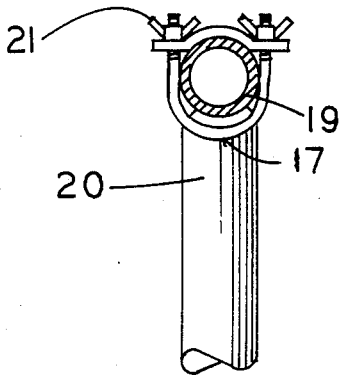
FIG. 2 Detail of another attaching means.
Figure 3:
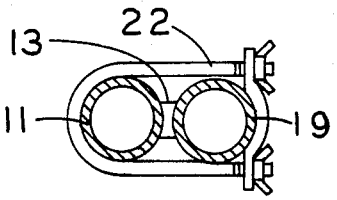
FIG. 3 Cross section taken along line 2—2 of FIG. 1, showing removable attachment means.

It is to be understood that the supporting and hold-on means may be varied, also as to the location on the trampoline, and the fastening and holding means between the various members may be varied, but will not depart from the spirit of this invention.

I claim:

1. In combination, an exercise steadying structure removably attached to a trampoline, said trampoline having a central resilient surface on a frame supported by a plurality of spaced apart legs, said resilient surface acting as a rebound surface, said exercise steadying structure comprising:

(a) two sturdy upright members positioned apart on one side of said trampoline, said upright members being removably attached to a respective first pair of legs of said trampoline, (b) said upright members joined and spanned at the top by a horizontal bar for user hold-on purposes, said bar having at each end a turned down sleeve section for slipping over the top end portions of said upright members for easy disassembly, (c) two diagonal support bar members each detachably connected at one end to the midpoint of a corresponding upright member and detachably connected at the other end to a respective second pair of legs of said trampoline; and (d) leg attachment means comprising double U-shaped inserts positioned between each trampoline leg and the corresponding upright member or support bar member, and U-bolt means for detachably securing each said leg to its corresponding member.

* * * * *